United States Patent [19]

Ide et al.

[11] Patent Number: 4,542,359

[45] Date of Patent: Sep. 17, 1985

[54] POLAR RELAY

[75] Inventors: Tatsumi Ide; Masayuki Morimoto, both of Tokyo, Japan

[73] Assignee: NEC Corporation, Tokyo, Japan

[21] Appl. No.: 546,837

[22] Filed: Oct. 31, 1983

[30] Foreign Application Priority Data

Nov. 2, 1982 [JP] Japan ..... 57-193213
Sep. 28, 1983 [JP] Japan ..... 58-179632

[51] Int. Cl.[4] ..... H01H 51/22
[52] U.S. Cl. ..... 335/78; 335/84; 335/202
[58] Field of Search ..... 335/78, 79, 80, 81, 335/84, 85, 202, 203, 230

[56] References Cited

U.S. PATENT DOCUMENTS 2,975,252 3/1961 Juptner ..... 335/85
4,020,434 4/1977 Jaegle et al. ..... 335/78

FOREIGN PATENT DOCUMENTS 1279838 10/1968 Fed. Rep. of Germany ..... 335/78

*Primary Examiner*—E. A. Goldberg
*Assistant Examiner*—George Andrews
*Attorney, Agent, or Firm*—Laff, Whitesel, Conte & Saret

[57] ABSTRACT

A polar relay comprises a contact spring assembly, a permanent magnet assembly, a winding assembly and an armature assembly which are arranged on a frame body assembly made of an insulating material. All the assemblies are positioned adjacent to and parallel to each other and are fit in the base during assembly. When mounted on a printed circuit board, the polar relay requires a minimum of area and enhances productivity.

24 Claims, 15 Drawing Figures

FIG. 5
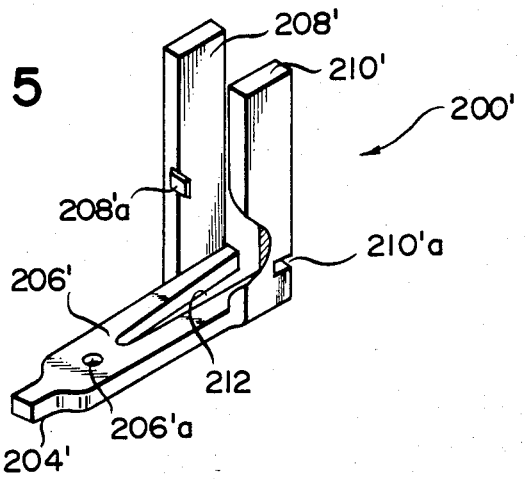
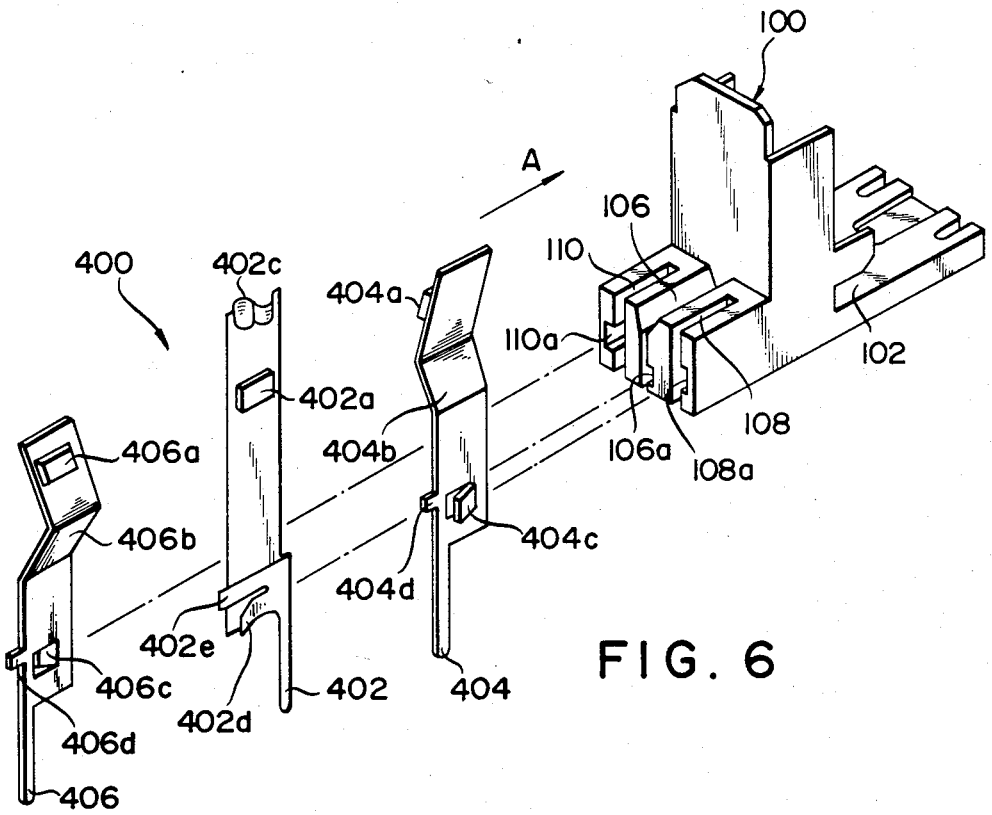
FIG. 6

POLAR RELAY

BACKGROUND OF THE INVENTION

The present invention relates to a polar relay and, more particularly, to a slim polar relay having structural elements arranged side by side on a base which is made of an insulating material.

Usually a polar relay includes at least one permanent magnet and a winding as electromagnetic drive means. An armature is moved by the magnetic operation of the electromagnetic drive means to move contact members into and out of engagement. A characteristic feature of the operation of a polar relay is that it is capable of holding the contact members in or out of engagement either in a monostable mode or in a bistable mode, depending upon the arrangement of the electromagnetic drive means. This type of polar relay finds various applications such as to communications equipments and domestic instruments (television sets, air conditioners, etc.).

Concerning the application to the communications equipments in which the trend to smaller and more integrated designs is ever increasing, it is desirable that the polar relay be provided with a shape and size which is feasible for installation on a printed circuit board together with very small electronic parts, occupying a minimum of space on the circuit board. In an ordinary communications equipment, various circuit parts are loaded on a printed circuit board to constitute a package and a plurality of such packages are mounted side by side on a package shelf. Among all the dimensions of a polar relay, therefore, the height requires a special consideration to set up a flat configuration. Indeed, various flat polar relays have already been proposed.

Meanwhile, where a polar relay is applied to a domestic instrument, particularly a television set or an air conditioner, a slim configuration is desirable rather than the flat configuration in view of effective utilization of space. Tendency in the field of such domestic instruments is to mount on a printed circuit board a capacitor having a large capacity and other elements having relatively large heights, requiring a polar relay to occupy a smallest possible area on the printed circuit board. A larger circuit switching capacity is another important consideration in the application of a polar relay to a domestic instrument. A polar relay fulfilling all these considerations has not been developed yet.

SUMMARY OF THE INVENTION

It is therefore an object of the present invention to provide a slim polar relay which needs only a small area for installation by juxtaposing a winding assembly and a permanent magnet assembly, which serve as electromagnetic drive means, and a contact spring assembly on an insulative frame body.

It is another object of the present invention to provide a polar relay which enhances productivity, particularly automatic assembly which trims costs, by allowing structural elements thereof to be assembled by fitting into an insulative frame body.

It is another object of the present invention to provide a polar relay which is capable of operating either in a monostable mode or in a bistable mode without recourse to any substantial modification in configuration or arrangements of the structural elements.

It is another object of the present invention to provide a polar relay which is capable of increasing the contact switching capacity by readily increasing the contact gap and the force of contact engagement.

It is another object of the present invention to provide a generally improved polar relay.

A polar relay of the present invention comprises a frame body assembly made of an insulating material and including a flat base, a contact spring assembly mounted in one end portion of the base, a permanent magnet assembly mounted on the base to neighbor the contact spring assembly, winding assembly mounted in the other end portion of the base to neighbor the permanent magnet assembly, and an armature assembly for driving the contact spring assembly in response to a magnetic field developed by exciting the winding assembly and a magnetic field developed by the permanent magnet assembly, the contact spring assembly, the permanent magnet assembly and the winding assembly being individually mounted upright and parallel to each other by fitting on the base of the frame body assembly.

The above and other objects, features and advantages of the present invention will become apparent from the following detailed description taken with the accompanying drawings.

BRIEF DESCRIPTION OF THE DRAWINGS

FIG. 5 is a partly taken away perspective view of another permanent magnet assembly applicable to the construction of FIG. 2;

FIG. 6 is a perspective view of a contact spring assembly and an insulative frame body included in the construction of FIG. 2;

DESCRIPTION OF THE PREFERRED EMBODIMENTS

While the polar relay of the present invention is susceptible of numerous physical embodiments, depending upon the environment and requirements of use, substantial numbers of the herein shown and described embodiments have been made, tested and used, and all have performed in an eminently satisfactory manner.

To facilitate understanding of the present invention, a brief reference will be made to a prior art polar relay, illustrated in FIG. 1. In the prior art polar relay, a permanent magnet assembly, a contact spring assembly and a winding assembly are arranged in series along the axis of the winding, appearing elongate as a whole. A section accommodating the winding assembly may be compressed to reduce the capacity of the winding in order to cut down the whole dimensions.

Figure 1:
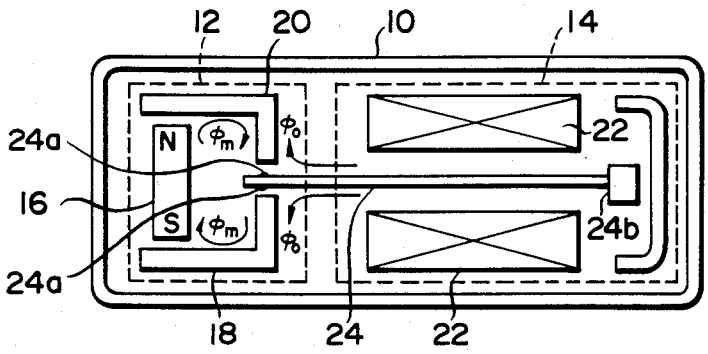
FIG. 1 PRIOR ART
FIG. 1 is a view of an exemplary arrangement of structural elements of a magnetic circuit which is installed in a prior art polar relay.

Referring to FIG. 1, the prior art polar relay comprises a housing 10 in which are installed a permanent magnet assembly 12 and a winding assembly 14. The permanent magnet assembly 12 is made up of a permanent magnet 16 and a pair of stationary contacts 18 and 20 adapted to form a magnetic flux circuit. The assembly 12 sets up a closed circuit of a magnetic flux $\phi_m$ (arrow) developed by the magnet 16. The winding assembly 14, on the other hand, comprises a winding 22, and a movable armature 24 made of a resilient conductor. The armature 24 is provided with contacts 24*a* at one end thereof and fixed in position at the other end as at 24*b*.

Supposing that magnetic fluxes $\phi_o$ have developed as indicated by arrows in response to a current fed to the winding 22, a closed magnetic loop is set up from the movable armature 24 back to it via the stationary contacts 18 and 20, housing 10 and air gap between the housing 10 and armature 24. The magnetic flux $\phi_o$ adds itself to the magntic flux $\phi_m$ developed by the magnet 16 at the stationary contact 18 while cancelling it at the other stationary contact 20. As a result, the armature 24 is attracted by the stationary contact 18 until the contact 24*a* adjacent to the contact 18 becomes engaged therewith, thereby developing an electric closed circuit. When the current through the winding 22 is reversed in direction, the direction of the magnetic flux will be reversed to cause the contact 24*a* adjacent to the stationary contact 20 to develop an electric closed circuit therewith.

The movable armature 24 is arranged parallel to the axis of the coil 22 and designed to serve as a movable contact at one end thereof, so that it may define a flux path in response to the winding current and thereby afford the function of a polar relay. For this reason, the permanent magnet assembly 12 with the stationary contacts 18 and 20 is located on an extension of the axis of the winding 22. The addition of the length of the permanent magnet assembly 12 to that of the winding assembly 14 results in a considerable length of the housing 10. Effected by the coil assembly 14 and/or the permanent magnet assembly 12, the housing 10 has to be provided with a generally columnar configuration.

The conductive stationary contacts 18 and 20 individually have outlet terminals (not shown). Likewise, the armature 24 serving as a movable contact has an outlet terminal (not shown) at its fixed end 24*b*. The relay exhibits its function including the contact portions of the electric circuit which includes the outlet terminals mentioned above. Each of the structural elements having a contact is assembled while being electrically insulated from the permanent magnet 16, housing 10 and winding 22.

A drawback encountered with the prior art polar relay described above is that the columnar configuration imposes limitation on the installation thereof on a printed circuit board or the like, which is the predominant base plate used today. Another drawback is in the production line aspect, that is, the productivity is poor due to the intricate manner of mounting and adjusting various parts of the polar relay.

Figure 2:
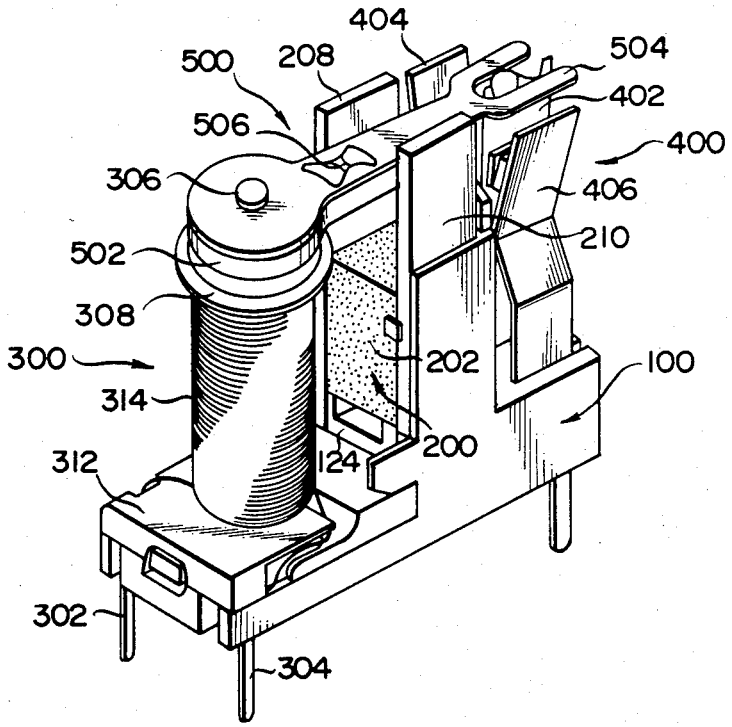
FIG. 2 is a perspective view of a polar relay embodying the present invention.
Figure 3:
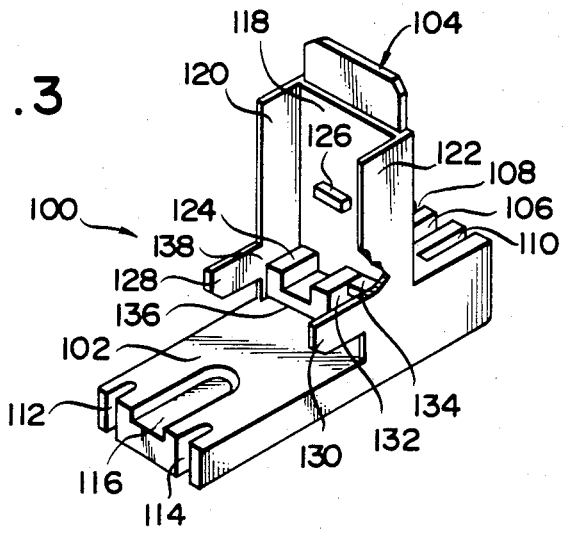
FIG. 3 is a partly taken away perspective view of an insulative frame body in accordance with the embodiment shown in FIG. 2.

Referring to FIG. 2, a polar relay embodying the present invention free from the drawbacks discussed is shown and includes an insulative frame body 100, which is made of synthetic resin. Details of the frame body 100 are best shown in FIG. 3. The frame body 100 includes a base 102 and an insulative upright wall 104 extending from an intermediate portion of the base 102 and having a generally U-shaped cross-section. At one end, the base 102 is formed with a plurality of recesses 106, 108 and 110 for respectively receiving flat springs 402, 404 and 406 of a contact spring assembly 400, which will be described. At the other end, the base 102 is formed with a pair of recesses 112 and 114 for respectively leading outlet terminals 302 and 304 of a winding of a winding assembly 300 to the outside, and a recess 116 for accommodating an excess length of a lower end portion of a magnetic pin 306, which serves as a core.

The upright wall 104 of the frame body 100 comprises a first wall portion 118, and parallel second and third wall portions 120 and 122 which individually extend from the first wall portion 118 such that the wall assembly has a generally U-shaped cross-section. A shelf 124 for supporting a permanent magnet 202 of a permanent magnet assembly 200, which will appear later, protrudes from the first wall portion 118. Also protruding from the first wall portion 118 is a lug 126 which will contact the top of the permanent magnet 202 when the latter is placed on the shelf 124. The second and third wall portions 120 and 122 respectively have extensions 128 and 130 which will be engaged with a flange 312 of a bobbin 308 included in the coil assembly 300.

Figure 4:
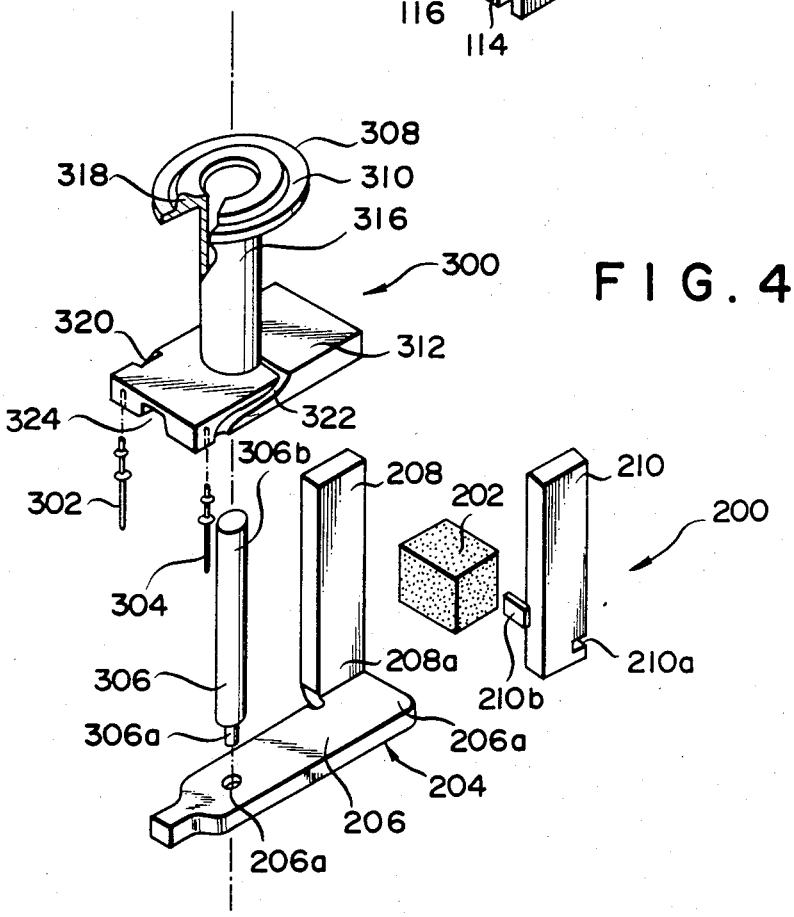
FIG. 4 is an exploded perspective view of a permanent magnet assembly and a winding assembly applicable to the construction shown in FIG. 2.

The permanent magnet assembly 200 and coil assembly 300 are shown in detail in FIG. 4.

The permanent magnet assembly 200 comprises a permanent magnet 202 and a yoke 204. The magnet 202 has N and S poles at opposite ends thereof. The yoke 204 is made up of a flat first magnetic plate 206, a second magnetic plate 208 extending from and perpendicular to the first magnetic plate 206, and a third magnetic plate 210 which faces the second magnetic plate 208 to retain the magnet 202 in cooperation therewith. The second magnetic plate 208 is formed longer than the third 210 and, therefore, the first and third magnetic plates 206 and 210 of the yoke 204 will not magnetically directly couple with each other. With such a structure, the yoke 204 serves to set up a monostable magnetic circuit as will become apparent later from the description of operation.

The winding assembly 300, on the other hand, comprises a magnetic pin 306 which is mounted upright on the first magnetic plate 206 of the yoke 204 with a lower end 306*a* thereof having a reduced diameter press fit in an opening 206*a* formed throughout the plate 206. The bobbin 308 is coupled over the magnetic pin 306 on the plate 206, the pin 306 constituting a core. A winding 314 (see FIG. 1) is wound around a shank 316 which interconnects a first flange 310 and a second flange 312 of the bobbin 308. The first flange 310 of the bobbin 308 is formed with an annular projection 318 for pivotally supporting an armature 502 thereon which is included in an armature assembly 500 as will be described. The second flange 312 is formed with channels 320 and 322 for guiding the winding 314 from the shank 316. Terminals 302 and 304 are individually studded on the second flange 312 to be connected with the ends of the winding 314. Also formed in the second flange 312 is a recess 324 in which the first magnetic plate 206 of the yoke 204 will be suitably received.

The permanent magnet assembly 200 and winding assembly 300 are put together with the intermediary of the pin 306 which is studded on the first magnetic plate 206 of the yoke 204. To set the assemblies 200 and 300 on the frame body 100 shown in FIG. 3, the magnet 202 is coupled between the shelf 124 and the lug 126 which extend from the wall 104 of the frame body 100. Then, the third plate 210 of the yoke 204 is placed in a gap 132 between the third wall portion 122 and the shelf 124. In this instance, a notch 210*a* formed in the third plate 210 is engaged with a projection 134 of the wall 104, so that the lower end of the plate 210 may be positioned at a predetermined spacing from the first plate 206 of the yoke 204. This spacing establishes a magnetic circuit necessary for the monostable operation of the relay. The reference numeral 210*b* in FIG. 4 designates an ear press-formed integrally with the third plate 210 of the yoke 204 in order to more positively retain the magnet 202, although it does not constitute any essential part of the present invention.

Thereafter, the permanent magnet assembly 200 and winding assembly 300 already in the integral structure is mounted on the frame body 100 such that an end portion 206*a* of the first plate 206 of the yoke 204 becomes fit in a space 136 between the base 102 and the shelf 124 of the frame body 100, and a lower portion 208*a* of the second plate 208 is coupled in a space 138 between the second wall 120 and shelf 124 of the wall 104. In this condition, an end portion of the second flange 312 of the winding assembly 300 remains in engagement with the opposite extensions 128 and 130 of the frame body 100, while the terminals 302 and 304 studded on the second flange 312 are respectively nested in the recesses 112 and 114 of the base 102. The assemblies 200 and 300 are firmly coupled together in the manner described and as shown in FIG. 2.

FIG. 5 shows an alternative construction of the yoke which is designed to provide a bistable function, as distinguished from the monostable function described. As shown, a permanent magnet assembly 200' includes a yoke 204' which comprises an integral assembly of a first magnetic plate 206', and second and third magnetic plates 208' and 210' which face each other at one end of the first plate 206' and have a common length. Although not shown in FIG. 5, a permanent magnet is retained between the second and third plates 208' and 210' in the same manner as the magnet 202 shown in FIG. 4. A substantially V-shaped notch 212 extends from one end toward the other end of the first plate 206' in order to prevent the second and third plates 208' and 210' from magnetically shortcircuiting, that is, setting up a flux path between the first plate 206' and the second plate 208' and a flux path between the first plate 206' and the third plate 210'. The third plate 210' is formed with a notch 210'*a* while the second plate 208' is provided with an ear 208'*a*. The notch 210'*a* and ear 208'*a* function in the same manner as those associated with the third plate 210 shown in FIG. 4.

The permanent magnet assembly 200' of the bistable polar relay is engaged with the winding assembly 300 by fitting the reduced lower end 306*a* of the pin 306 in an opening 206'*a* which is formed throughout the first plate 206'. The procedure for mounting the assemblies 200' and 300 on the frame body 100 is the same as one previously described with reference to FIG. 3.

In this manner, the magnetic circuit of the polar relay can be designed for the monostable function or the bistable function as desired without resorting to any modification in the structure of the winding assembly 300, which is combined with the magnet assembly 200 or 200'. However, where only the bistable function is desired, the projection 134 of the frame body 100 and the notch 210'*a* of the third plate 210' of the yoke 204' are omissible. Concerning the monostable polar relay, on the other hand, the shelf 124 of the frame body 100 may be extended as far as the third plate 122 carries the third plate 210 of the yoke 204 instead of forming the projection 134, and the notch 210*a* of the third plate 210 is omissible.

Referring to FIG. 6, the contact spring assembly 400 is shown which is also mounted on the frame body 100 shown in FIG. 3. The assembly 400 comprises a movable contact spring 402 and a pair of stationary contact springs 404 and 406, which are respectively fit in the recesses 106, 108 and 110 of the frame body 100 in a direction indicated by an arrow A. The movable contact spring 402 is formed by machining a flexible conductive material into a predetermined shape. Movable contact members 402*a* and 402*b* (only 402*a* is shown) are welded or otherwise rigidly fit on opposite surfaces of an upper end portion of the contact spring 402. The contact spring 402 has a hemispherical projection 402*c* at the upper edge thereof which is engageable with a contact spring drive member as will be described. A pawl 402*d* is positioned in a bent, lower end of the contact spring 402 which will abut against the wall of a groove 106*a* in the recess 106 when the contact spring 402 is inserted into the recess 106.

Each of the stationary contact springs 404 and 406 is made of a conductive plate. Stationary contact members 404*a* and 406*a* are rigidly fit on upper end portions of the contact springs 404 and 406 respectively. Pawls 404*c* and 406*c* are formed respectively at lower end portions of the contact members 404 and 406 such that they will abut against the walls of grooves 108*a* and 110*a* in the recesses 108 and 110. The upper and lower end portions of the contact members 404 and 406*a* are respectively interconnected by bent, intermediate portions 404*b* and 406*b*. The pawl 402*d* of the movable contact spring 402 and the pawls 404*c* and 406*c* are adapted to prevent their associated contact springs 402, 404 and 406 from slipping out of the recesses 106, 108 and 110 respectively. Further, projections 402*e*, 404*d* and 406*d* located at the lower ends of the contact springs 402, 406 and 408 respectively, are adapted to prevent a filling agent from reaching the upper surface of the base 102 of the frame body 100 through the recesses 106, 108 and 110 when the filling agent is injected into the back surface of the frame body 100.

Figure 7:
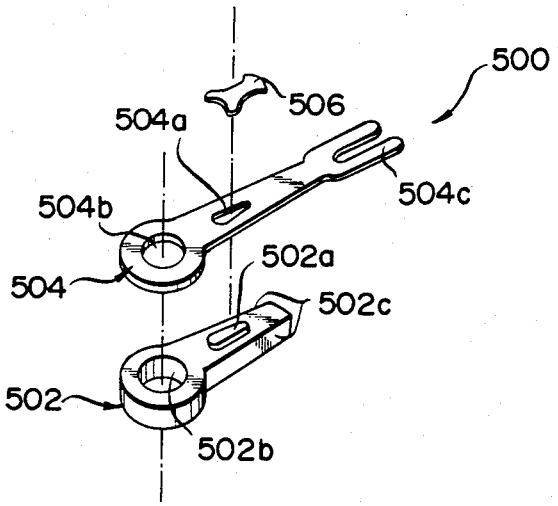
FIG. 7 is an exploded perspective view of an armature assembly applicable to the embodiment of FIG. 2.

Referring to FIG. 7, an armature assembly is shown and generally designated by the reference numeral 500. The armature assembly 500 comprises a pivotable armature 502 made of a magnetic material, and a contact spring driver or card 504 made of an insulating material. The armature 502 is formed with a lug 502*a*, while the driver 504 is formed with an opening 504*a* in which the lug 502*a* is received. A curved clamping member 506 is welded to the lug 502 to securely interconnect the armature 502 and driver 504. The integral assembly of the armature 502 and driver 504 is built in the relay with their circular openings 502*b* and 504*b* engaged with an upper end 306*b* of the magnetic pin 306 shown in FIG. 4. To make the armature assembly 500 rotatable about the pin 306, the opening 502*b* of the armature 502 and the opening 504*b* of the driver 504 are engaged with the pin 306 by a suitable degree of fitting.

As will be more clearly understood when reference is made to FIG. 2 in addition to FIG. 7, a forked actuating end 504*c* of the driver 504 receives the hemispherical projection 402*c* of the movable contact spring 402, which has already been mounted on the frame body 100. Opposite contact ends 502*c* of the armature 502 are individually disposed in a polar space defined between the second and third magnetic plates 208 and 210 of the magnet assembly 200. The dielectric strength between the armature 502 and the driver 504 extending into the polar space is insured by the first wall portion 118 (best shown in FIG. 3) of the wall 104 in the frame body 100.

The description made so far will suffice to show the manner of constructing the polar relay illustrated in FIG. 2.

Figure 8:
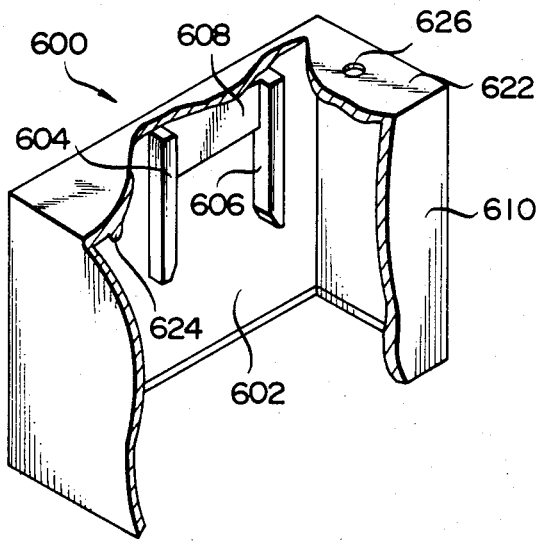
FIG. 8 is a partly taken away perspective view of a casing applicable to the embodiment of FIG. 2.

Referring to FIG. 8, a housing for accommodating the relay of FIG. 2 is shown and generally designated by the reference numeral 600. The housing 600 is made of synthetic resin and provided with a predetermined configuration. An integral assembly of lugs 604 and 606 and a stepped member 608 interconnecting the lugs 604 and 606 is located on an inner surface of a first wall 602 of the housing 600. Although not shown in the drawing, an integral assembly of lugs 612 and 614 and a stepped member 616 similar to the above-described assembly is located on the inner surface of a second wall 610, which opposes the first wall 602. The lugs 604 and 606 are adapted to hold the second wall portion 120 of the frame body 100 therebetween, thereby positioning the second plate 208 of the yoke 204 which is located inwardly of the wall portion 120. Likewise, the lugs 612 and 614 hold the third wall portion 122 of the frame body 100 therebetween so as to position the third plate 210 of the yoke 204, which is located inwardly of the wall portion 120.

A third wall portion 622 of the housing 600 has on its inner surface a projection 624 which abuts against the contact spring driver 504 in order to prevent the armature assembly 500 on the bobbin 308 from being separated. The wall portion 622 is formed with an aperture 626 which will function as an inlet for sealing gas or an outlet for gas which may enter the housing 600 during sealing with a filling agent, which will be described.

The housing 600 having the above structure is put on the relay of FIG. 2 from above through the open bottom thereof. A filling agent is injected into the bottom of the base 102 of the frame body 100, which is engaged with the open bottom of the housing 600, in order to hermetically confine the frame body 100, magnet assembly 200, wiring assembly 300, contact spring assembly 400 and armature assembly 500 in the housing 600. After the injection of the filling agent, an invert gas is introduced into the housing 600 through the aperture 626 and, then, the aperture 626 is plugged. This completes a hermetically sealed polar relay.

The polar relay constructed as described above will be operated as follows.

Figure 9A:
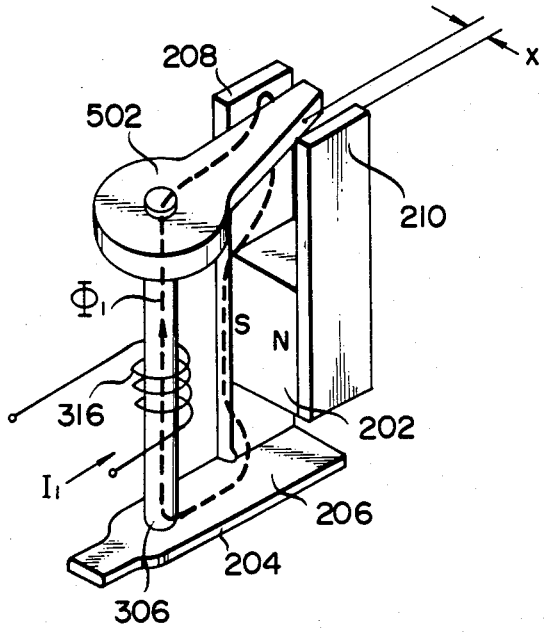
FIGS. 9*a* and 9*b* are perspective views of an exemplary monostable magnetic circuit attainable with the embodiment shown in FIG. 2.
Figure 9B:
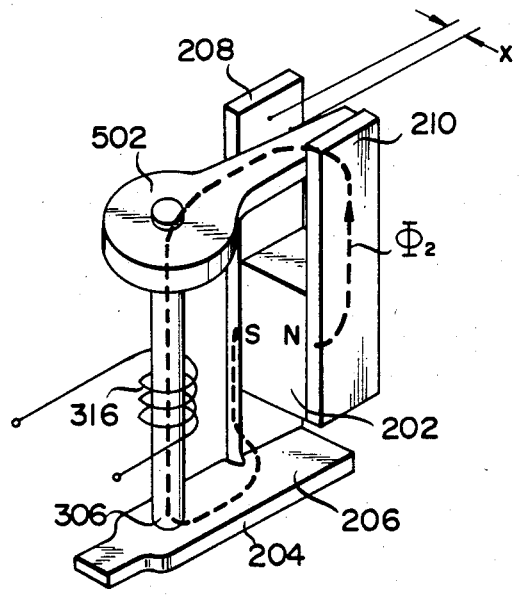

First, a magnetic circuit operable in the monostable mode will be described with reference to FIGS. 9*a* and 9*b*. While a current $I_1$ is supplied to the winding 316, the resulting main flux $\phi_1$ forms a loop through the magnetic pin 306, armature 502, second magnetic plate 208 of the yoke 204, and first magnetic plate 206 of the first magnetic plate 206. In this condition, the armature 502 is magnetically attracted by the second magnetic plate 208. Although not shown, the contact spring driver 504 interlocked with the armature 502 drives the movable contact spring 402 toward the stationary contact spring 404, thereby causing the contact members 402*a* and 404*a* to engage each other.

As soon as the supply of current $I_1$ to the winding 316 is interrupted, the magnetic attraction is reduced beyond the resistance of the movable contact spring load. As a result, the armature 502 is magnetically attracted by the third magnetic plate 210 of the yoke 204 under the influence of a main flux $\phi_2$ which passes through the third plate 210, armature 502, pin 306, first plate 206 and second plate 208, as shown in FIG. 9*b*. Therefore, the movable contact spring 402 driven by the driver 504 brings its movable contact 402*b* into engagement with the stationary contact 406*a* on the stationary contact spring 406. This situation is maintained until the current $I_1$ has been fed to the winding 316.

Figure 10A:
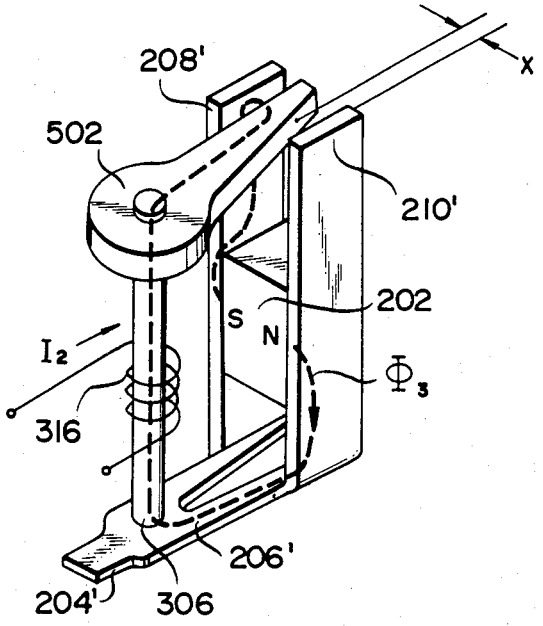
FIGS. 10*a* and 10*b* are perspective views of a bistable magnetic circuit also attainable with the embodiment of FIG. 2.

A magnetic circuit of the bistable mode type will be described with reference to FIGS. 10*a* and 10*b*. In this case, the magnitude of the magnetic attraction acting on the armature 502 is determined by the permanent magnet 202. The situation wherein the armature 502 is attracted by the second plate 208' or the third plate 210' of the yoke 204' is maintained by the magnetic attraction by the permanent magnet 202 which exhibits antisymmetrical characteristic curves which overcome the resistance of the movable contact spring load. As shown in FIG. 10*a*, when a pulse current $I_2$ is fed to the winding 316 while the armature 502 is attracted by the second plate 208', a magnetic flux $\phi_3$ passing through the magnet 202, third plate 210', first plate 206', pin 306 and second plate 208' is reduced, causing the armature 502 to be attracted by the third plate 210' this time, as shownin FIG. 10*b*.

Figure 10B:
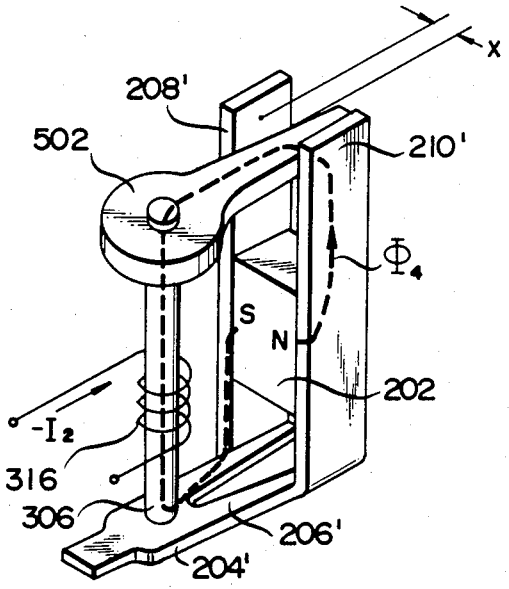

In the condition shown in FIG. 10*b* the armature 502 is magnetically retained by the third plate 210' due to a flux $\phi_4$ which passes through the magnet 202, third plate 210', armature 502, pin 306, first plate 206' and second plate 208'. In response to a pulse current $-I_2$ fed to the winding 316, the flux $\phi_4$ is reduced to switch the armature 502 toward the second plate 208'. Because the driver 504 actuates the movable contact spring 402 in response to a movement of the armature 502, the movable contact 402*a* on the spring 402 is selectively engaged with the stationary contact 404*a* on the stationary contact spring 404, and the movable contact 402*b* with the stationary contact 406*a*.

In the magnetic circuit of the first embodiment of the present invention, whether the monostable type or the bistable type, the magnetic fluxes $\phi_2$, $\phi_3$ and $\phi_4$ developed by the magnet 202 for attracting the armature 502 is dependent upon the energy product and sectional area of the magnet 202. The magnitude of magnetic attraction is proportional to each of such magnetic fluxes. Hence, an increase in the engaging force between the contacts is readily attainable by increasing the lengthwise dimensions of the second and third plates 208 (208') and 210 (210') and, thereby, the sectional areas thereof. Meanwhile, the polar space defined by the second and third plates 208 (208') and 210 (210') of the yoke 204 (204') is located midway between the position where the magnetic pin defining a pivot axis for the armature 502 is located and the position where the contact springs are located. For this reason, and because the stroke x of the armature 502 may be made large be selecting a leverage between the armature 502 and the driver 504 accordingly, the contact gap can be increased with ease. Therefore, a polar relay having a large contact switching capacity can be realized.

Figure 11:
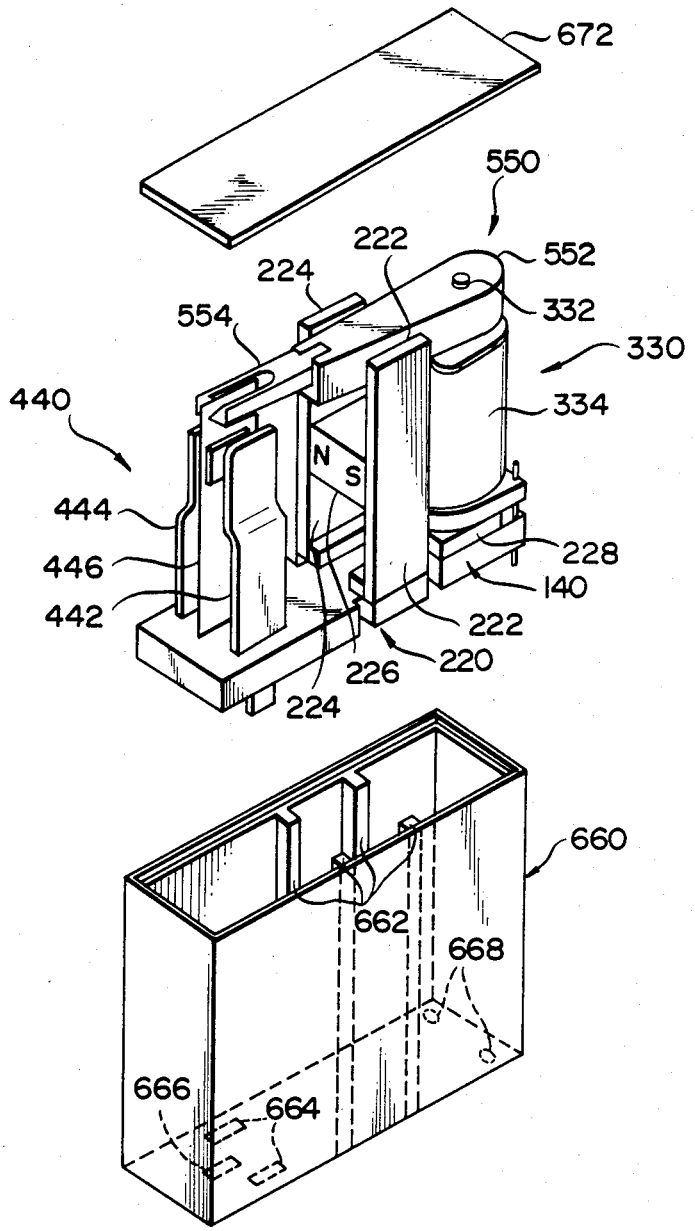
FIG. 11 is a perspective view of a second embodiment of the present invention.

Referring to FIG. 11, a second embodiment of the present invention is shown. In this embodiment, a frame body 140 is made of a nonmagnetic, electrically insulating material and has a winding assembly 330 and a contact spring assembly 440 located adjacent to each other at opposite sides of first and second magnetic plates 222 and 224 of a permanent magnet assembly 220. Although not shown in the drawing, the frame body 140 is formed with slots for receiving stationary contact springs 442 and 444 and a movable contact spring 446, an opening for receiving a magnetic pin 332, and apertures for terminals at which the winding terminates. Further, the frame body 140 is formed with four recesses, two at one side of the plates 222 and 224 and two at the other side, which receive and position projections 662 on a housing 660, which will be described.

The contact spring assembly 440 comprises three contact springs 442, 444 and 446 each having a contact at one end and a terminal at the other end. The contact springs are arranged parallel to each other such that the contact spring, which is movable, is selectively bent into contact with the contact spring 442 or 444. The assembly 440 is fixed on one surface of the frame body 140 such that the magnet assembly 220 and winding assembly 330 are positioned in a direction perpendicular to the bending direction of the contact spring 446, the terminals projecting from the other surface of the frame body 140.

In the permanent magnet assembly 220, two parallel magnetic plates 222 and 224 are directly bonded to the pole surfaces of a permanent magnet 226. After the assembly, a magnetic plate 228 engaged with the bottom of the winding assembly 330 and having a generally U-shaped terminal portion sets up an integral structure by having one of the U-shaped terminals bonded to one end of the magnetic plate 222 and the other end to the magnetic plate 224, each with a predetermined magnetic resistance. The magnetic plates 222 and 224 face each other at the other end thereof at a spacing which allows an armature 552 of an armature assembly 550 to move therein. The magnet assembly 220 is located parallel to the contact spring assembly 440 with the magnetic plate 228 held in intimate contact on the surface of the frame body 140. The magnetic plates 222 and 224 oppose each other in the direction parallel to the moving direction of the movable contact spring 446.

The winding assembly 330 comprises a magnetic pin or core 332 and a winding 334 wound around the pin 332. One end of the pin 332 extends throughout the magnetic plate 228 to be studded on the frame body 140, while the other end defines a pivot axis for the armature 552. The winding assembly 330 is fixed to the frame body 140 together with the magnet assembly 220 using openings (not shown) formed throughout the magnetic plate 228.

In the armature assembly 550, the armature 552 comprises a magnetic member which is formed with an opening to receive the pin 332 at one end thereof. A card 554 made of an insulator for moving the movable contact spring 446 is held at the other end of the armature 552. The armature end with the opening is pivotally mounted on the top of the pin 332, the other armature end is located between upper ends of the opposite magnetic plates 222 and 224, and the card 554 movably retains the upper end of the movable contact spring 446. When actuated, the armature 552 causes the card 554 to move the contact spring 446 into and out of contact with the contact spring 442 or 444.

The housing 660 is made of a nonmagnetic material and formed at its bottom with slots 664 for drawing out the contact springs 442 and 444, a slot 666 for drawing out the contact spring 446, and apertures 668 for terminals associated with the winding 334. A measure for electric insulation is furnished with in the housing 660. As already described, four projections 662 extend on opposite sides of the housing 660 perpendicular to the bottom in order to facilitate insertion of the completed relay assembly into the housing 660.

In accordance with the second embodiment, electric insulation needs be considered only for the contact spring assembly 440 and winding 334. While the armature 552 has been shown and described as being pivotable about the pin 332 which is studded on the frame body 140, it may be constructed integrally with the pin 332 to be movable therewith. The integral armature and pin construction would enhance the magnetic efficiency in the magnetic circuit in the armature 552. The number of contact springs in the assembly 440 is not limited to three and may be four or more to increase the available number of combinations of contact circuits, in which case the card 554 has to be modified accordingly. If desired, the flat contact springs may be replaced by linear contact springs to further trim the overall dimensions of the relay. Although a top lid 672 is shown to close the housing 660, it may be formed integrally with the housing 660 with the bottom of the housing 660 removed instead, for the purpose of further reducing manufacturing steps. The bottom open housing will be put on the completed relay construction from above, the frame body 140 constituting the bottom of the housing 600.

Figure 12:
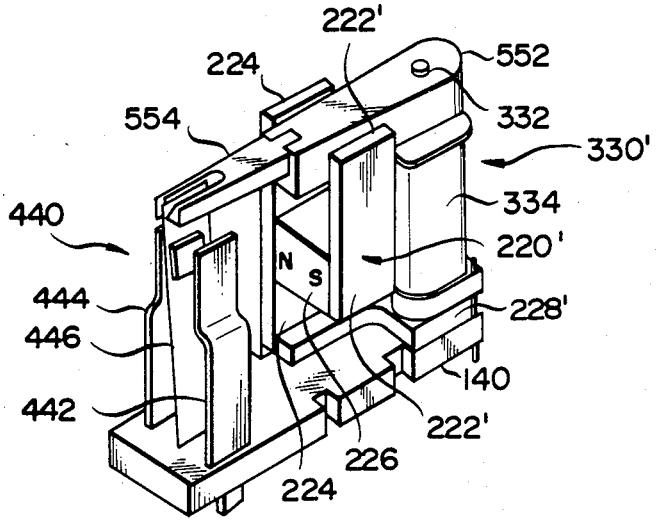
FIG. 12 is a perspective view of a modification to the second embodiment of FIG. 11.

Referring to FIG. 12, a modification to the embodiment shown in FIG. 11 is illustrated. This embodiment is distinguished from that shown in FIG. 11 in that one of the opposite magnetic plates in the assembly 330 is cut away in a portion thereof which is adjacent to the frame body 140. In FIG. 12, the same structural elements as those shown in FIG. 11 are designated by the same reference numerals. The structure, arrangement and operation identical with those described in conjunction with the second embodiment will not be described for convenience.

In FIG. 12, a magnetic plate 228' is engaged at one end with a polarized surface of the permanent magnet 226, while facing the magnetic plate 224 at the other end. One leg of the U-shaped ends of the plate 228 is cut away. While a current is not flowing through the winding 334, the magnetic flux of the magnet 226 forms a loop through a magnetic plate 222', magent 226, lower portion of the magnetic plate 224, magnetic plate 228', magnetic pin 332 and armature 552, thereby causing the plate 222' to attract the armature 552. As a result, the card 554 associated with the armature 552 moves the movable contact spring 446 to bring the contact into engagement with the stationary contact spring 442.

When a current is fed to the winding 334 to set up a magnetic loop through the armature 552, pin 332, plate 228' and plate 224, the magnetic flux in the plate 222' is cancelled by a magnetic flux originated from the excitation of the winding 334 so that the armature 552 is attracted toward the plate 224. The card 554 then moves to disengage the movable contact spring 446 from the stationary contact spring 442 and bring it into engagement with the other stationary contact spring 444. In this case, the flux developed from the magnet 226 and the flux originated from the excitation of the winding add to each other in an upper portion of the plate 224, cumulatively driving the armature 552. This intensifies the magnetic attraction force and lowers the working current value. The principle previously described in the second embodiment also applies to this modification concerning the location for electric insulation, pivot point for the armature, combination of contacts, spring configuration, and housing configuration. In accordance with this modification, as shown in FIG. 12, where the plate 222' faces the plate 224 at one end thereof while being secured to the magnet 226 at the other end, and the plates 224 and 228' are integrated without magnetic resistance, the magnetic circuit will attain the maximum efficiency.

Figure 13:
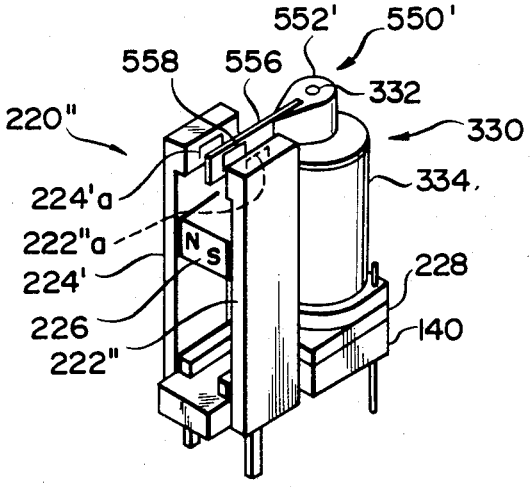
FIG. 13 is a perspective view of another modification to the second embodiment of FIG. 11.

Referring to FIG. 13, another modification to the second embodiment of FIG. 11 is shown. A characteristic feature of this modification is that the two magnetic plates of the magnet assembly 220 are employed as stationary contact springs, and part of the armature 552 of the armature assembly 550 as a movable contact spring. In FIG. 13, the same structural elements as those shown in FIG. 11 are designated by the same reference numerals.

In FIG. 13, an armature assembly 550' comprises a movable contact spring 556 which carries a movable contact 558 for switching electric circuit at the leading end thereof. A permanent magnet assembly 220'' comprises an integral construction of the permanent magnet 226, and parallel magnetic plates 222'' and 224' which hold the pole surfaces of the magnet 226 therebetween, with an electric insulator intervening therebetween. Stationary contacts 222''*a* and 224'*a* are respectively carried on upper end portions of the plates 222'' and 224' to face each other at a predetermined spacing. The movable contact 558 on the movable contact spring 556 is interposed between the stationary contacts 222''*a* and 224'*a*.

In the structure shown in FIG. 13, the flux of the magnet 226 sets up two different loops: a loop passing through the magnet 226, upper end of the plate 224', stationary contact 224'*a*, air gap in which the movable contact 558 is disposed, stationary contact 222''a, and upper portion of the plate 222'', and a loop passing through the magnet 226, lower portion of plate 224', plate 228 mediated by the air gap, and lower portion of the plate 222''. When a current is fed to the winding 334, a flux may flow, for example, through the pin 332, amature 552', movable spring 556, contact 558, contact 222''*a*, upper portion of plate 222'', magnet 226, lower portion of plate 224', and plate 228 mediated by the air gap. This flux loop causes the plate 222'' to attract the movable spring 556 of the armature 552', thereby completing an electric circuit which includes the pin 332, amature 552', movable spring 556, contact 558, contact 222''*a* and plate 222''. The contact switching action results from a change in the direction of a current flowing through the winding 334. The winding assembly 330 and permanent magnet assembly 220'' are located as close to each other as possible in order to enhance the efficiency of the flux path created by the current through the winding 334.

While the armature 552' has been shown and described as comprising a leaf spring, it may comprise a rigid member if a resilient structure is employed in the section where it is fixed in place. If desired, the plates 222'' and 224' may be constructed integrally with the magnetic member 228 at lower portions thereof and with a predetermined magnetic resistance. This would stabilize the magnetic circuit of the plates 222'' and 224' as a permanent magnet assembly, thereby further facilitating assembly and adjustment of the relay.

In summary, it will be seen that the present invention provides a slim polar relay which requires a minimum of space for installation thereof, due to the parallel arrangement of a winding assembly and a permanent magnet assembly, which constitute magnetic drive means, and a contact spring assembly on an insulating frame body.

Various structural elements of the relay are fit into the frame member to improve productivity, particularly cut-down in cost due to automatic assembly.

The relay of the present invention achieves the monostable or biastable function as desired without any substantial modification in the configuration or arrangement of the structural elements.

Furthermore, the present invention is capable of readily increasing the contact gap and contact engagement force to increase the contact switching capacity.

Various modifications will become possible for those skilled in the art after receiving the teachings of the present disclosure without departing from the scope thereof. For example, in all the embodiments described, the members described as being made of conductors may be replaced by insulators if contacts and their associated terminals are individually electrically interconnected by at least one of leads and printed circuits. The projections in any of the housings described may be in the form of discontinuous strips of projections.

What is claimed is:

1. A polar relay comprising:

a frame body assembly made of an insulating material and including a flat base;

a contact spring assembly mounted in one end portion of said base;

a permanent magnet assembly mounted on the base to neighbor said contact spring assembly;

a winding assembly mounted in the other end portion of the base to neighbor said permanent magnet assembly; and an armature assembly for driving the contact spring assembly in response to a magnetic field developed by exciting the winding assembly and a magnetic field developed by the permanent magnet assembly;

the contact spring assembly, the permanent magnet assembly and the winding assembly being individually mounted upright and parallel to each other by fitting on the base of the frame body assembly;

the frame body assembly comprising a first wall portion rising from a substantially intermediate portion of the base to isolate longitudinally opposite ends of the base from each other, a second wall portion and a third wall portion each being contiguous with said first wall portion and rising from the base to define a substantially U-shaped cross section in cooperation with the first wall portion, and a shelf extending from the first wall portion.

2. A polar relay as claimed in claim 1, further comprising a housing for accommodating all the assemblies therein.

3. A polar relay as claimed in claim 1, in which the permanent magnet assembly comprises a first magnetic plate arranged flat on the base and having one end thereof held between the base and the shelf, a second magnetic plate held between the shelf and the second wall portion and rising along the second wall portion, a third magnetic plate held between the shelf and the third wall portion and rising along the third wall portion, and a permanent magnet laid on the shelf with magnetic pole sections thereof abutted against the second and third magnetic plates respectively.

4. A polar relay as claimed in claim 3, in which the winding assembly comprises a magnetic pin studded in the other end portion of the first magnetic plate, and a bobbin having a hollow shank around which a winding is carried, said bobbin being coupled over the magnetic pin.

5. A polar relay as claimed in claim 4, in which the contact spring assembly comprises at least one movable contact spring and at least two stationary contact springs.

6. A polar relay as claimed in claim 5, in which the armature assembly comprises an armature which is coupled with the magnetic pin of the winding assembly at one end thereof so that the other end thereof is movable to selectively engage with the second and third magnetic plates of the permanent magnet assembly, and a contact spring driver having a free end which extends beyond said other end of said armature and is engaged with the movable contact spring.

7. A polar relay as claimed in claim 6, in which one of the second and third magnetic plates of the permanent magnet assembly is integrally connected to the one end of the first magnetic plate, the other of the magnetic plates being located at a spacing from the one end of the first magnetic plate, thereby constituting a monostable magnetic circuit.

8. A polar relay as claimed in claim 6, in which the second and third magnetic plates of the permanent magnet assembly are integrally connected to the one end of the first magnetic plate, said one end of the first magnetic plate being formed with a notch to set up a bistable magnetic circuit.

9. A polar relay as claimed in claim 6, further comprising a housing for accommodating all the assemblies, said housing comprising a pair of projections formed on opposite inner surfaces thereof in order to retain the second magnetic plate which extends along the second wall portion and the third magnetic plate which extends along the third wall portion.

10. A polar relay as claimed in claim 1, in which the frame body assembly comprises a first magnetic plate arranged flat on the base.

11. A polar relay as claimed in claim 10, in which the winding assembly comprises a magnetic pin which is magnetically coupled at one end thereof with the first magnetic plate of the frame body assembly, the other end of the magnetic pin being pivotally engaged with the armature assembly, said magnetic pin being studded on the base, and a winding wound around said magnetic pin.

12. A polar relay as claimed in claim 19, in which the permanent magnet assembly comprises a second magnetic plate and a third magnetic plate facing each other at one end thereof, the pivotal end of the armature assembly being disposed between said facing ends of the second and third magnetic plates, the other end of at least one of the second and third magnetic plates being connected to the first magnetic plate, said second and third magnetic plates being mounted upright in parallel to the magnetic pin and the winding, and a permanent magnet having magnetic pole ends thereof held by the second and third magnetic plates respectively.

13. A polar relay as claimed in claim 12, in which the contact spring assembly comprises a contact member movable between a closing position and an opening position in response to a movement of the armature assembly which is selectively attracted by the second and third magnetic plates by a magnetic field developed by the magnet and a magnetic field which develops when a current is fed to the winding.

14. A polar relay as claimed in claim 13, in which the first magnetic plate is integral with at least one of the second and third magnetic plates.

15. A polar relay as claimed in claim 14, in which the contact member actuated by the armature assembly comprises a resilient conductive member which is studded on a major surface of the base in a juxtaposed relation with the second and third magnetic plates.

16. A polar relay as claimed in claim 15, in which an insulating member for driving the resilient conductive member is positioned at least at the pivotal end of the armature assembly.

17. A polar relay as claimed in claim 13, in which the contact member is carried by each of the armature, the magnetic pin, and the second and third magnetic plates.

18. A polar relay as claimed in claim 13, further comprising a housing for accommodating all the assemblies, said housing comprising more than one projections at positions which hold the second and third magnetic plates therebetween, the base having recesses to be individually engaged with said projections.

19. A polar relay comprising:

a frame body assembly made of an insulating material and including a flat base;

a contact spring assembly mounted in one end portion of said base;

a permanent magnet assembly mounted on the base to neighbor said contact spring assembly;

a winding assembly mounted in the other end portion of the base to neighbor said permanent magnet assembly; and an armature assembly for driving the contact spring assembly in response to a magnetic field developed by exciting the winding assembly and a magnetic field developed by the permanent magnet assembly;

the contact spring assembly, the permanent magnet assembly and the winding assembly being individually mounted upright and parallel to each other by fitting on the base of the frame body assembly;

the frame body assembly comprising a first magnetic plate arranged flat on the base;

the winding assembly comprising a magnetic pin which is magnetically coupled at one end thereof with the first magnetic plate of the frame body assembly, the other end of the magnetic pin being pivotally engaged with the armature assembly, said magnetic pin being studded on the base, and a winding wound around said magnetic pin.

20. A polar relay comprising:

a frame body assembly made of an insulating material and including a flat base;

a contact spring assembly mounted in one end portion of said base;

a permanent magnet assembly mounted on the base to neighbor said contact spring assembly;

a winding assembly mounted in the other end portion of the base to neighbor said permanent magnet assembly; and an armature assembly for driving the contact spring assembly in response to a magnetic field developed by exciting the winding assembly and a magnetic field developed by the permanent magnet assembly;

the contact spring assembly, the permanent magnet assembly and the winding assembly being individually mounted upright and parallel to each other by fitting on the base of the frame body assembly;

the frame body assembly comprising a first wall portion rising from a substantially intermediate portion of the base to isolate longitudinally opposite ends of the base from each other, a second wall portion and a third wall portion each being contiguous with said first wall portion and rising from the base to define a substantially U-shaped cross section in cooperation with the first wall portion, and a shelf extending from the first wall portion;

the permanent magnet assembly comprising a first magnetic plate arranged flat on the base and having one end thereof held between the base and the shelf, a second magnetic plate held between the shelf and the second wall portion and rising along the second wall portion, a third magnetic plate held between the shelf and the third wall portion and rising along the third wall portion, and a permanent magnet laid on the shelf with magnetic pole sections thereof abutted against the second and third magnetic plates respectively;

the winding assembly comprising a magnetic pin studded in the other end portion of the first magnetic plate, and a bobbin having a hollow shank around which a winding is carried, said bobbin being coupled over the magnetic pin;

the contact spring assembly comprising at least one movable contact spring and at least two stationary contact springs;

the armature assembly comprising an armature which is coupled with the magnetic pin of the winding assembly at one end thereof so that the other end thereof is movable to selectively engage with the second and third magnetic plates of the permanent magnet assembly, and a contact spring driver having a free end which extends beyond said other end of said armature and is engaged with the movable contact spring.

21. The polar relay as claimed in claim 20, in which one of the second and third magnetic plates of the permanent magnet assembly is integrally connected to the one end of the first magnetic plate, the other of the magnetic plates being spaced away from the one end of the first magnetic plate, thereby constituting a monostable magnetic circuit.

22. The polar relay as claimed in claim 20 in which the second and third magnetic plates of the permanent magnet assembly are integrally connected to the one end of the first magnetic plate, said one end of the first magnetic plate being formed with a notch to set up a bistable magnetic circuit.

23. The polar relay as claimed in claim 20, further comprising a housing for accommodating all the assemblies, said housing comprising a pair of projections formed on opposite inner surfaces thereof in order to retain the second magnetic plate which extends along the second wall portion and the third magnetic plate which extends along the third wall portion.

24. A polar relay comprising:

a frame body assembly made of an insulating material and including a flat base;

a contact spring assembly mounted in one end portion of said base;

a permanent magnet assembly mounted on the base to neighbor said contact spring assembly;

a winding assembly mounted in the other end portion of the base to neighbor said permanent magnet assembly; and an armature assembly for driving the contact spring assembly in response to a magnetic field developed by exciting the winding assembly and a magnetic field developed by the permanent magnet assembly;

the contact spring assembly, the permanent magnet assembly and the winding assembly being individually mounted upright and parallel to each other by fitting on the base of the frame body assembly;

the frame body assembly comprising a first magnetic plate arranged flat on the base;

the winding assembly comprising a magnetic pin which is magnetically coupled at one end thereof with the first magnetic plate of the frame body assembly, the other end of the magnetic pin being pivotally engaged with the armature assembly, said magnetic pin being studded on the base, and a winding wound around said magnetic pin;

the permanent magnet assembly comprising a second magnetic plate and a third magnetic plate facing each other at one end thereof, the pivotal end of the armature assembly being disposed between said facing ends of the second and third magnetic plates, the other end of at least one of the second and third magnetic plates being connected to the first magnetic plate, said second and third magnetic plates being mounted upright in parallel to the magnetic pin and the winding, and a permanent magnet having magnetic pole ends thereof held by the second and third magnetic plates respectively;

the contact spring assembly comprising a contact member movable between a closing position and an opening position in response to a movement of the armature assembly which is by selectively attracted by the second and third magnetic plates by a magnetic field developed by the magnet and a magnetic field which develops when a current is fed to the winding;

the first magnetic plate being integral with at least one of the second and third magnetic plates;

the contact member actuated by the armature assembly comprising a resilient conductive member which is studded on a major surface of the base in a juxtaposed relationship with the second and third magnetic plates;

an insulating member for driving the resilient conductive member being positioned at least at the pivotal end of the armature assembly;

said relay further comprising a housing for accommodating all the assemblies, said housing comprising more than one projections at positions which hold the second and third magnetic plates therebetween, the base having recesses to be individually engaged with said projections.

* * * * *